US008152014B2

(12) United States Patent
Elstone, Sr. et al.

(10) Patent No.: US 8,152,014 B2
(45) Date of Patent: Apr. 10, 2012

(54) COLLAPSIBLE CONTAINER SYSTEM

(75) Inventors: Paul J. Elstone, Sr., Burlington, NJ (US); Daniel L. Clemens, Columbus, NJ (US); Thomas F. Craig, Willingboro, NJ (US); Robert M. Murnane, Jr., Hammonton, NJ (US)

(73) Assignee: Paul J. Elstone, Sr., Burlington, NJ (US)

( * ) Notice: Subject to any disclaimer, the term of this patent is extended or adjusted under 35 U.S.C. 154(b) by 1945 days.

(21) Appl. No.: 11/103,143

(22) Filed: Apr. 11, 2005

(65) Prior Publication Data

US 2006/0226143 A1 Oct. 12, 2006

(51) Int. Cl.
*B65D 6/18* (2006.01)
*B65D 8/14* (2006.01)

(52) U.S. Cl. ..... 220/6; 220/4.28

(58) Field of Classification Search ..... *B65D 6/18,6/26, B65D 6/00, 8/14, 8/04*
See application file for complete search history.

(56) References Cited

U.S. PATENT DOCUMENTS

| | | | | | |
|---|---|---|---|---|---|
| 2,486,532 | A * | 11/1949 | Kubach | 206/583 |
| 2,573,089 | A * | 10/1951 | Armenia | 217/15 |
| 2,811,275 | A * | 10/1957 | Draper | 220/7 |
| 2,936,985 | A * | 5/1960 | Doerr et al. | 108/55.1 |
| 3,048,147 | A * | 8/1962 | McKean | 119/496 |
| 3,178,216 | A * | 4/1965 | Huber | 294/68.1 |
| 3,529,741 | A * | 9/1970 | Tabron et al. | 220/7 |
| 3,620,388 | A * | 11/1971 | Mansson | 108/53.1 |
| 3,635,368 | A * | 1/1972 | Winsor | 220/6 |
| 3,760,970 | A * | 9/1973 | Lutz | 220/4.28 |
| 4,099,640 | A * | 7/1978 | Nessfield et al. | 220/6 |
| 4,295,431 | A * | 10/1981 | Stavlo | 108/55.1 |
| 4,735,330 | A * | 4/1988 | Hoss | 220/6 |
| 4,798,304 | A * | 1/1989 | Rader | 220/6 |
| 5,106,246 | A * | 4/1992 | Chance | 410/26 |
| 5,109,999 | A * | 5/1992 | Instone et al. | 220/1.5 |
| 5,193,700 | A * | 3/1993 | Lyman et al. | 220/1.5 |
| 5,601,201 | A * | 2/1997 | Looker | 220/1.5 |
| 5,611,449 | A * | 3/1997 | Pedersen | 220/6 |
| 5,755,472 | A * | 5/1998 | Clive-Smith | 294/67.1 |
| 5,967,356 | A * | 10/1999 | Laarhoven et al. | 220/6 |
| 6,050,410 | A * | 4/2000 | Quirion | 206/386 |
| 6,290,081 | B1 * | 9/2001 | Merey | 220/7 |
| 6,415,938 | B1 * | 7/2002 | Karpisek | 220/1.5 |
| 6,585,304 | B1 * | 7/2003 | Boozer et al. | 294/178 |
| 6,868,979 | B2 * | 3/2005 | Rader | 220/7 |
| 7,083,369 | B2 * | 8/2006 | Nyeboer | 410/43 |
| 7,156,249 | B2 * | 1/2007 | Heinrichs | 220/4.28 |
| 2002/0179601 | A1 * | 12/2002 | Haruhiro | 220/6 |
| 2003/0190207 | A1 * | 10/2003 | Junge | 410/3 |
| 2005/0229820 | A1 * | 10/2005 | Reynard | 108/55.1 |

FOREIGN PATENT DOCUMENTS

GB 2022663 A * 12/1979

* cited by examiner

*Primary Examiner* — Mickey Yu
*Assistant Examiner* — Robert J Hicks
(74) *Attorney, Agent, or Firm* — Walter J. Tencza, Jr.

(57) ABSTRACT

A first container is provided including a first base, a first wall, a second wall, a third wall, and a fourth wall. The first, second, third, and fourth walls, can each be placed in an erect state, substantially perpendicular to the first base or in a collapsed state substantially parallel to the first base. The first and second walls, which oppose each other, can also be placed in ramp states to allow a vehicle or cargo to be rolled over the first or second walls and onto the first base. Inverted J-shaped slots allow the first wall or the second wall to pivot about multiple pivot points with respect to the base.

5 Claims, 13 Drawing Sheets

COLLAPSIBLE CONTAINER SYSTEM

FIELD OF THE INVENTION

This invention relates to improved methods and apparatus concerning collapsible containers.

BACKGROUND OF THE INVENTION

Various container systems are known in the prior art.

SUMMARY OF THE INVENTION

The present invention, in one or more embodiments, provides a first container. The first container includes a first base comprised of first, second, third, and fourth sides The first container also includes first, second, third, and fourth walls, located adjacent to the first, second, third, and fourth sides of the base, respectively.

The first, second, third, and fourth walls, can each be placed in an erect or erected state, substantially perpendicular to the first base. The first container may also include a lid which can be connected to the first, second, third, and fourth walls in the erect state. The first, second, third, and fourth walls in their erect state typically form four sides of an open box structure and the first base forms a bottom of the open box structure. The lid can be used to close the open box structure.

The first wall can be placed in a ramp state in which the first wall lies adjacent to, but not on top of, the first base, and in which the first wall lies at an angle, which may be approximately five degrees with respect to the first base. The second wall, typically lying opposite the first wall, can also be placed in a ramp state in which the second wall lies adjacent to, but not on top of, the first base, and in which the second wall lies at an angle, which may be approximately five degrees with respect to the first base. In addition, the first, second, third, and fourth walls can be placed in a collapsed state in which the first, second, third, and fourth walls are substantially parallel to the first base.

A vehicle can be rolled over the first wall when the first wall is in its ramp state, and then rolled onto the first base. Similarly, a vehicle can be rolled over the second wall when the second wall is in its ramp state, and then rolled onto the first base. The first wall may be connected to the first base by a first axle which allows the first wall to pivot with respect to the first base. A first inverted J-shaped slot may be fixed to the third side of the first base and a second inverted J-shaped slot may be fixed to the fourth side of the first base. The third side of the first base is opposite the fourth side of the first base. The first axle may have a first end which is inserted into the first inverted J-shaped slot and a second end which is inserted into the second inverted J-shaped slot. The first and second inverted J-shaped slots allow the first wall to pivot about more than one pivot point with respect to the first base.

The apparatus may include a second container, similar to or identical to, the first container. The present invention includes a method of providing a first container as previously described, placing the walls in an erect state and then subsequently placing one or two of the walls in a ramp state. The method may also include rolling a vehicle over one of the walls in the ramp state and onto the base.

DETAILED DESCRIPTION OF THE DRAWINGS

Figure 1:
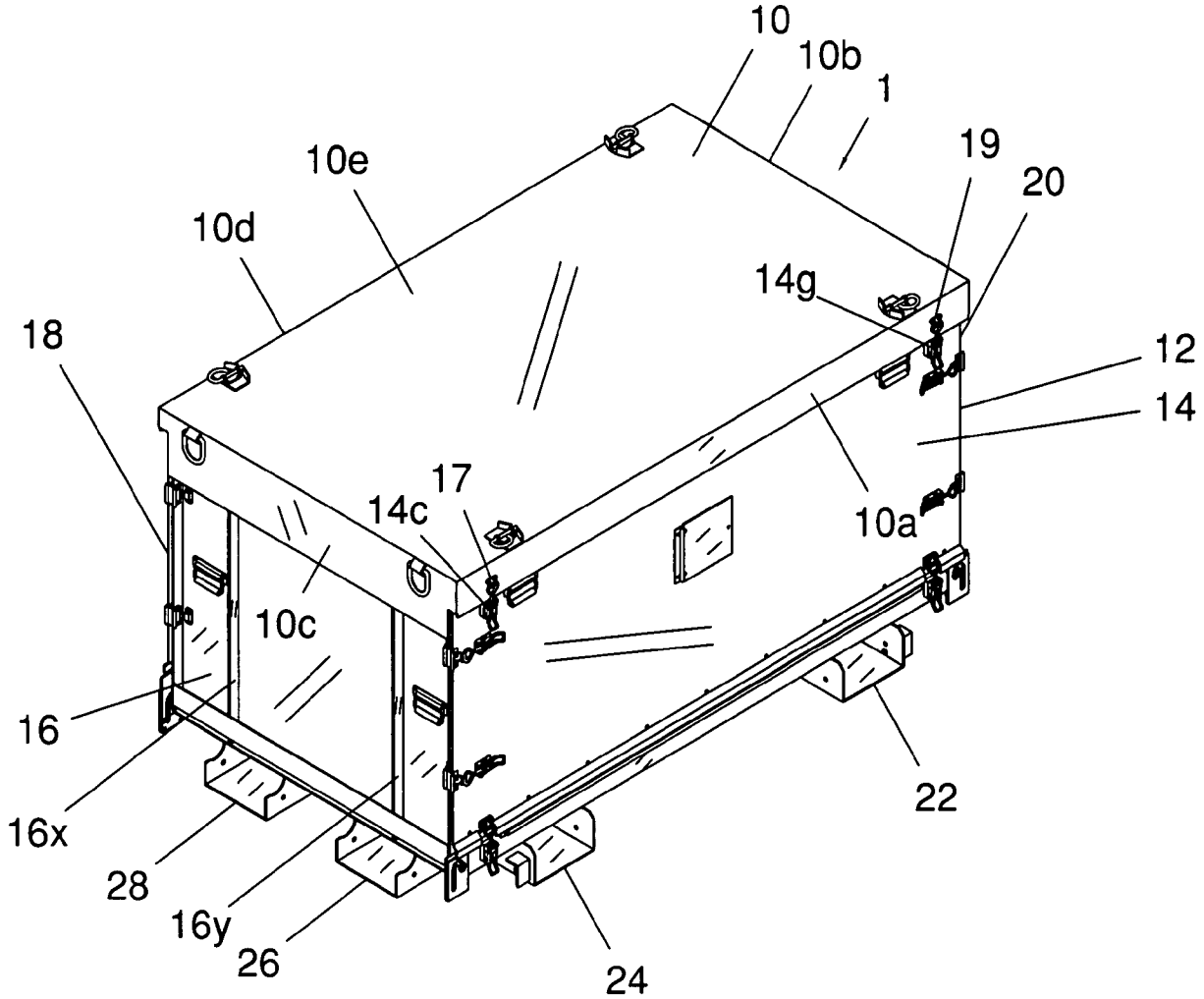
FIG. 1 shows a perspective view of a container, including a lid, in accordance with an embodiment of the present invention, with the container shown in a fully assembled and fully erect state.
Figure 2:
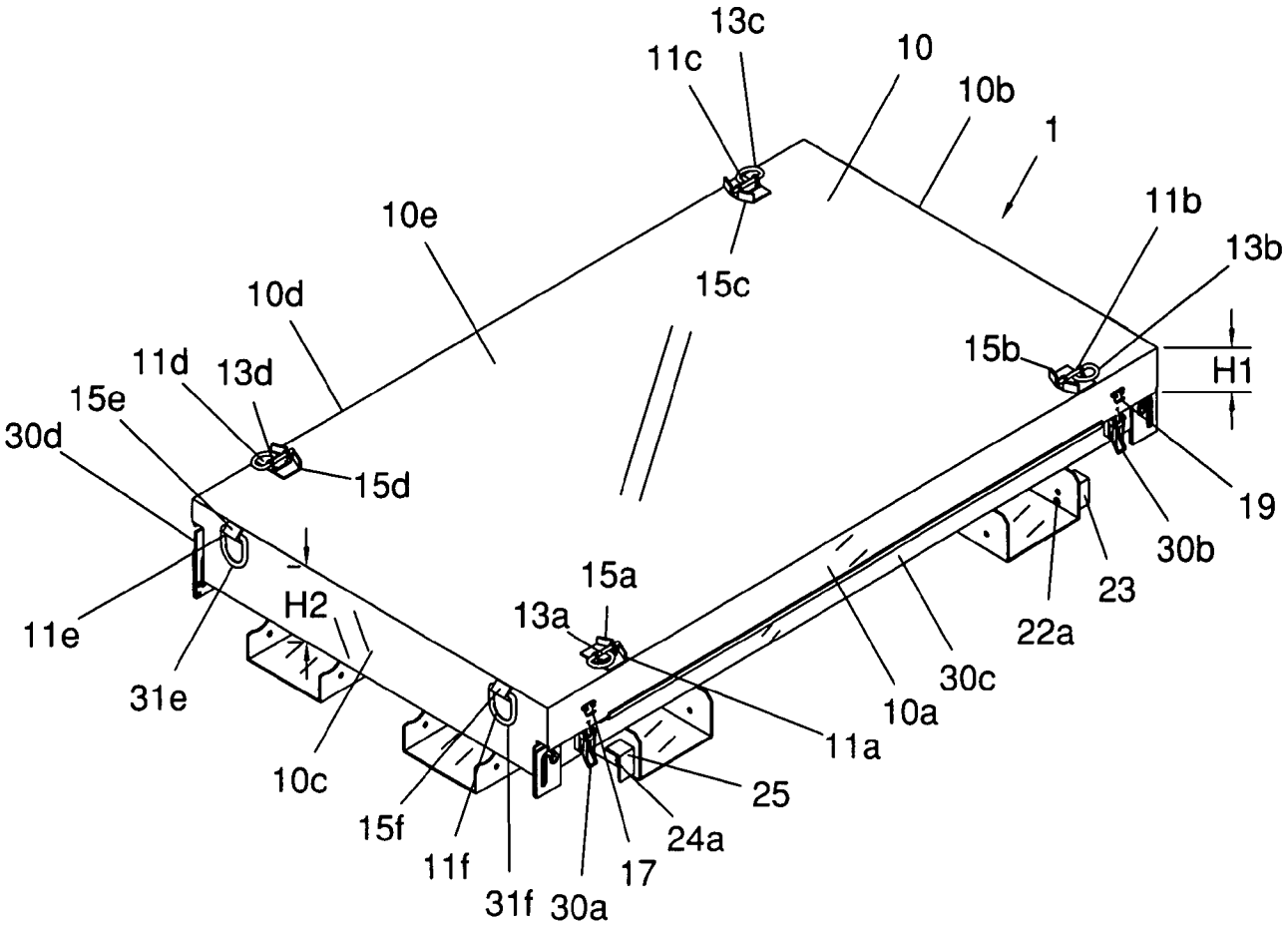
FIG. 2 shows a perspective view of the container of FIG. 1 in a fully assembled but collapsed state.
Figure 3:
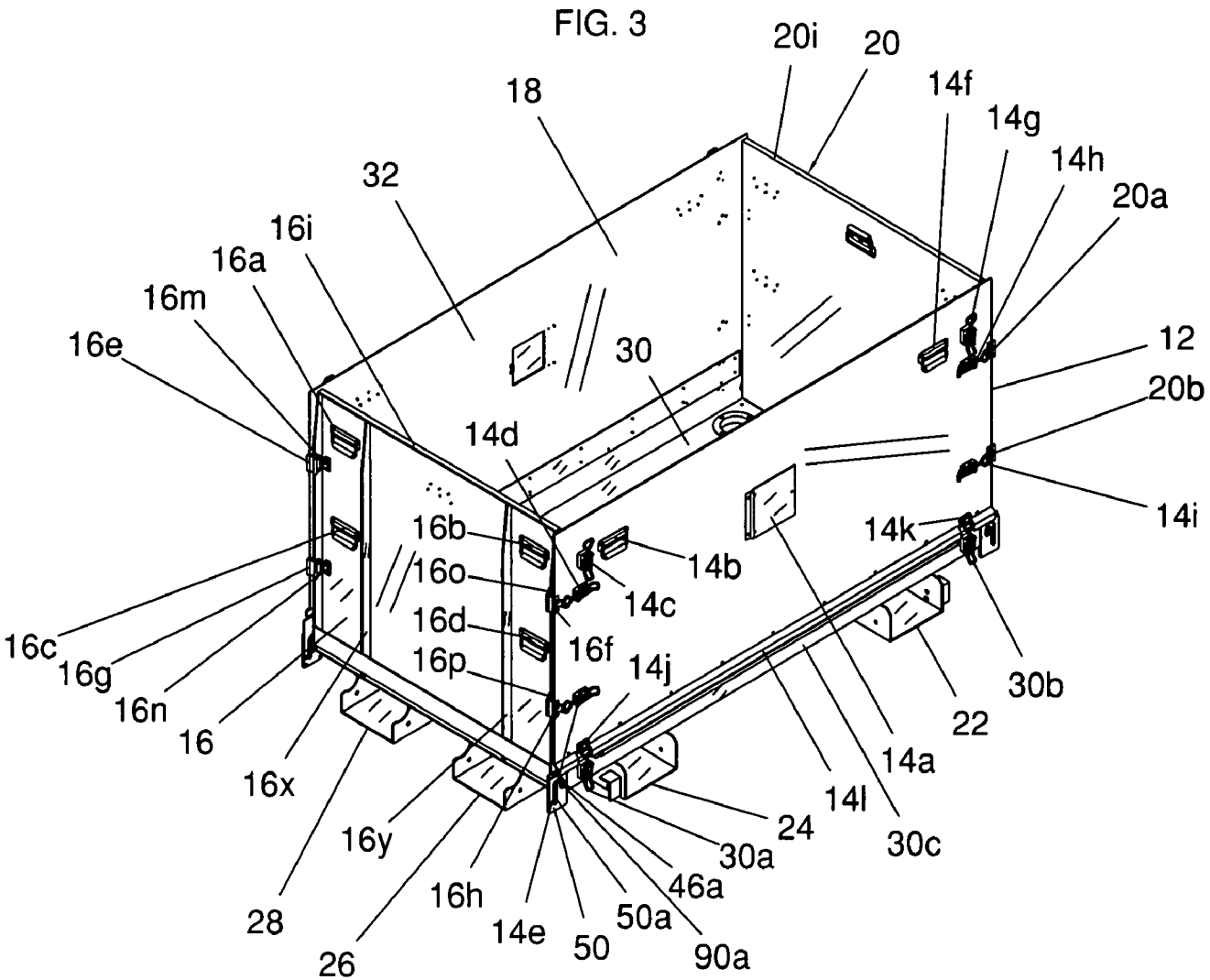
FIG. 3 shows a perspective view of a body portion of the container of FIG. 1, wherein the lid has been removed and is not shown, and wherein the body portion is in a fully erect state.

FIG. 1 shows a perspective view of a container 1, including a lid 10 and a body portion 12, in accordance with an embodiment of the present invention, with the container 1 shown in a fully assembled and fully erect state. FIG. 2 shows a perspective view of the container 1 of FIG. 1 in a fully assembled but collapsed state. FIG. 3 shows a perspective view of the body portion 12 of the container 1 of FIG. 1, wherein the lid 10 has been removed and is not shown, and wherein the body portion 12 is in a fully erect state.

The lid 10, as shown in FIGS. 1 and 2, includes a top surface 10*e*, and sides 10*a*, 10*b*, 10*c*, and 10*d*. Attachment devices 11*a*, 11*b*, 11*c*, and 11*d*, shown in FIG. 2, are attached to the top surface 10*e* of the lid 10. The attachment devices 11*a*, 11*b*, 11*c*, and 11*d* include slide bolts 13*a*, 13*b*, 13*c*, and 13*d*, respectively, which are pivotally connected to mounting devices 15*a*, 15*b*, 15*c*, and 15*d*, respectively, so that the slide bolts 13*a*-d can pivot with respect to the top surface 10*e*. Mounting devices 15*a*, 15*b*, 15*c*, and 15*d* serve several purposes. First, they vertically align the slide bolts 13*a*, 13*b*, 13*c*, and 13*d* with holes of forklift rails of a container similar to container 1, to be stacked on top of container 1. Mounting device 15*a* would be aligned with a hole, similar to hole 24*a* of rail 24 shown in FIG. 2, but for a container stacked on top of container 1. Mounting device 15*b* would be aligned with a hole, similar to hole 22*a*, but for a container stacked on top of container 1. Mounting device 15*d* would be aligned with a hole in the container stacked on top of container 1, similar to a hole opposite hole 24*a*, in the rail 24, near side 10*d* of the lid 10 in FIG. 2. Mounting device 15*c* would be aligned with a hole in the container stacked on top of container 1, similar to a hole opposite hole 22*a*, in the rail 22, near side 10*d* of the lid 10 in FIG. 2. Holes 22*a*, 24*a*, and holes at the opposite ends of the rails 22 and 24, not shown, allow the stacking and interlocking of multiple containers.

A second purpose of the mounting devices 15*a-d* is to act as guides for stacked containers. Third, the mounting devices 15*a-d* help to protect the slide bolts 13*a*, 13*b*, 13*c*, and 13*d* during the stacking process. Fourth, the mounting devices 15*a* and 15*b* act as a stop for another container, identical to container 1, stacked on top of container 1. The container 1 also includes angles 25 and 23 attached at one end of the rails 24 and 22 respectively, near side 10*a* of the lid 10 shown in FIG. 2. When angles similar to angles 25 and 23 of a container, similar to container 1, to be stacked on top of container 1, hit mounting devices 15*a* and 15*b*, respectively, the slide bolts 13*a* and 13*b*, respectively, can be engaged with the holes in the forklift rails, of the container stacked on top, similar to holes 24*a* and 22*a*. In addition, the slide bolts 13*c* and 13*d* can be engaged with holes in the forklift rails of the container stacked on top, similar to holes that are opposite holes 24*a* and 22*a* in the forklift rails 24 and 22 shown in FIG. 2.

Attachment devices 11*e* and 11*f* are attached to the side 10*c*. The attachment devices include rings 31*e* and 31*f*, which are pivotally connected by mounting devices 15*e* and 15*f*, so that the rings can pivot with respect to the side 10*c*. There are another two attachment devices, similar to 11*e* and 11*f*, another two rings similar to 31*e* and 31*f* and another two mounting devices similar to 15*e* and 15*f*, attached to side 10*b* of the lid 10, but not shown in FIG. 2. The attachment devices 11*e* and 1 1*f*, and the similar attachment devices not shown, but attached to side 10*b*, serve two purposes. First, they act as handles to allow the end user to remove the lid 10 from the container 1. Second, they allow the end user to tie down or secure the container 1 to a surface like a pallet. The sides 10*a*, and 10*d* may also include two attachment devices similar to 11*e* and 11*f*. The sides 10*a* and 10*d* have a height H1, shown in FIG. 2 which is about half of a height H2 of the sides 10*c* and 10*b*. The sides 10*c* and 10*b* each may be, but are not required to be, about half as long as the sides 10*a* and 10*d*. Latching devices 17 and 19 may be fixed to the side 10*a* and may be used to latch the side 10*a* to a front panel 14 when the container 1 is in the fully erect state of FIG. 1, and to the base 30 when the container 1 is in the collapsed state of FIG. 2. There may be similar latching devices provided on the side 10*d* of the lid 10.

The body portion 12 of the container 1 includes the front panel or wall 14, a left ramp or wall 16, a rear panel or wall 18, and a right ramp or wall 20. The body portion 12 also includes a base or bottom surface 30, shown partially in FIG. 3. The front panel 14, left ramp 16, rear panel 18, right ramp 20, and base 30, when in the upright or erect state of FIG. 3, define a cavity 32 into which cargo such as a small vehicle or all terrain vehicle (ATV) can be placed. The base 30 has sides 30*c*, and 30*d*, (FIG. 2) which can be latched to sides 10*a*, and 10*d* of the lid 10 in a fully collapsed state.

The front panel 14 may include an emergency access port 14*a*, handles 14*b* and 14*f*, latching devices 14*c*, 14*d*, 14*e*, 14*g*, 14*h*, 14*i*, 14*j*, and 14*k*. Latching devices 14*c* and 14*g* which engage with devices 17 and 19 on the lid 10, shown in FIG. 1, in order to secure the lid 10 in place. Latching devices 14*d* and 14*e* engage with latching devices 16*f* and 16*h*, respectively, located on the left ramp 16, to affix the front panel 14 to the left ramp 16. Latching devices 14*h* and 14*i* engage with latching devices 20*a* and 20*b*, respectively, located on the right ramp 20, to affix the front panel 14 to the right ramp 20. This gives rigidity and strength to the body portion 12 of the container 1. Handles 14*b* and 14*f* are used by an end user to lift and lower the front panel 14 during the collapsing and erecting of the container 1. The rear panel 18 may be, but is not required to be, identical to the front panel 14. The left ramp 16 may include handles 16*a*, 16*b*, 16*c*, and 16*d*, and latching devices 16*e*, 16*f*, 16*g*, and 16*h*. The handles 16*a-d* may be part of or attached to the left ramp 16. The right ramp 20 may be identical to the left ramp 16. The right ramp 20 may include handles similar to 16*a-d*. The left ramp 16 may include reinforcing members 16x and 16y, shown in FIG. 3. The right ramp 20 may include similar reinforcing members. The latching devices 14*j* and 14*k* of the front panel 14 may be connected to latching devices 30*a* and 30*b*, respectively, of base 30 to attach or latch front panel 14 to base 30.

The rear panel 18 may be latched to the left ramp 16 and to the right ramp 20 in a manner similar to the manner in which front panel 14 can be latched to the left ramp 16 and to the right ramp 20. The rear panel 18 may be latched to the base 30 in a manner similar to the manner in which the front panel 14 can be latched to the base 30. The right ramp 20 can be latched to the front panel 14 in a manner similar to the manner in which the left ramp 16 can be latched to the front panel 14.

Figure 13:
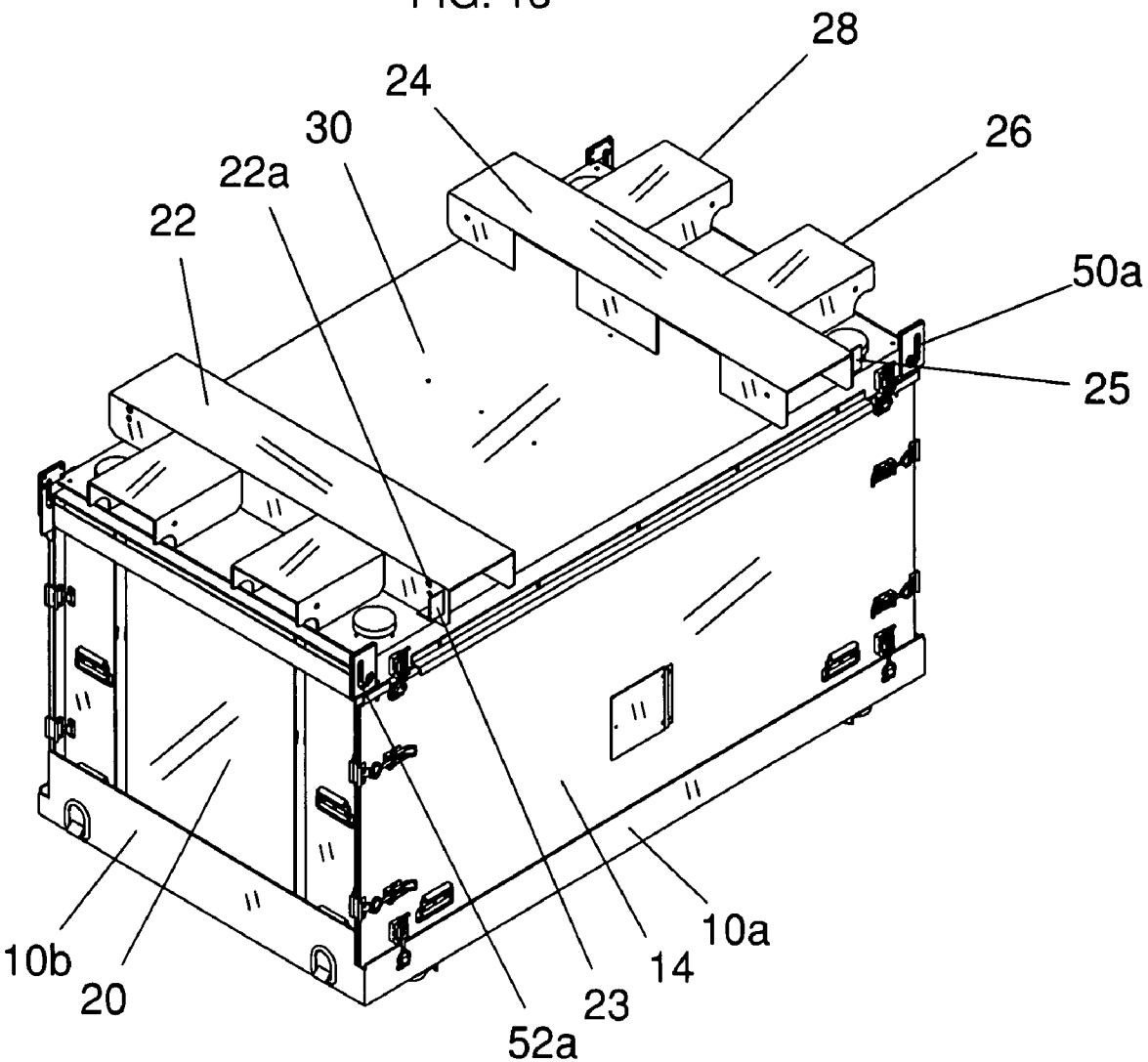
FIG. 13, shows a perspective view of the container of FIG. 1, flipped so that the bottom of the container of FIG. 1 can be seen.

The base 30 of the container 1 has attached thereto, forklift rails or slots 22, 24, 26, and 28. Two forklift rails, not shown, would also be provided opposite rails 26 and 28, near right ramp 20. FIG. 13, shows a perspective view of the container 1 flipped so that the bottom of the container 1 can be seen.

Figure 4:
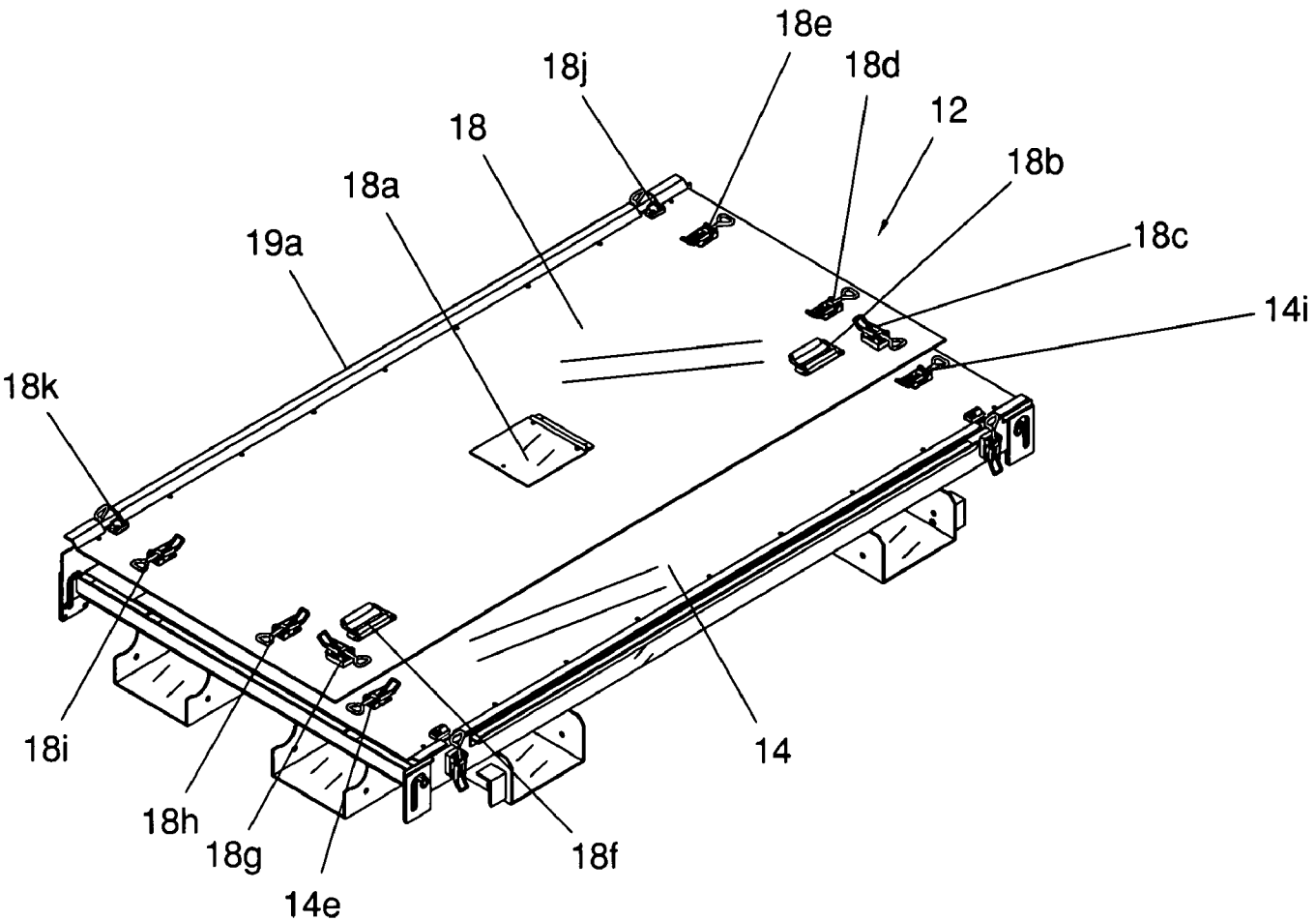
FIG. 4 shows a perspective view of the body portion of the container of FIG. 1, wherein a left ramp, a right ramp, a front panel, and a back panel of the body portion, are shown in a collapsed state.

FIG. 4 shows a perspective view of the body portion 12 of the container 1 of FIG. 1, wherein a first ramp 16, a second ramp 20, a front panel 14, and a back panel 18 of the body portion 12, are in a collapsed state. The back panel 18 is shown collapsed on top of the front panel 14. Portion 18*a* similar to portion 14*a* is shown in FIG. 4. Latching devices 18*h* and 18*i* for connecting or latching to latching devices 16*e* and 16*g*, of left ramp 16, respectively, are shown by the combination of FIGS. 3 and 4. Latching devices 18*d* and 18*e* for connecting to right ramp 20 are shown in FIG. 4. Latching devices 18*c* and 18*g* for connecting to lid 10, are shown in FIG. 4. Latching devices 18*j* and 18*k* for connecting to base 30 are shown in FIG. 4. The back panel 18 includes a flange 19*a* shown in FIG. 4, similar to a flange 14*l* for front panel 14, shown in FIG. 3. The back or rear panel 18 includes handles 18*b* and 18*f*, shown in FIG. 4, for lifting or rotating the rear panel 18 into an upright state or lowering, folding, and/or rotating the rear panel 18 into a collapsed state.

Figure 5:
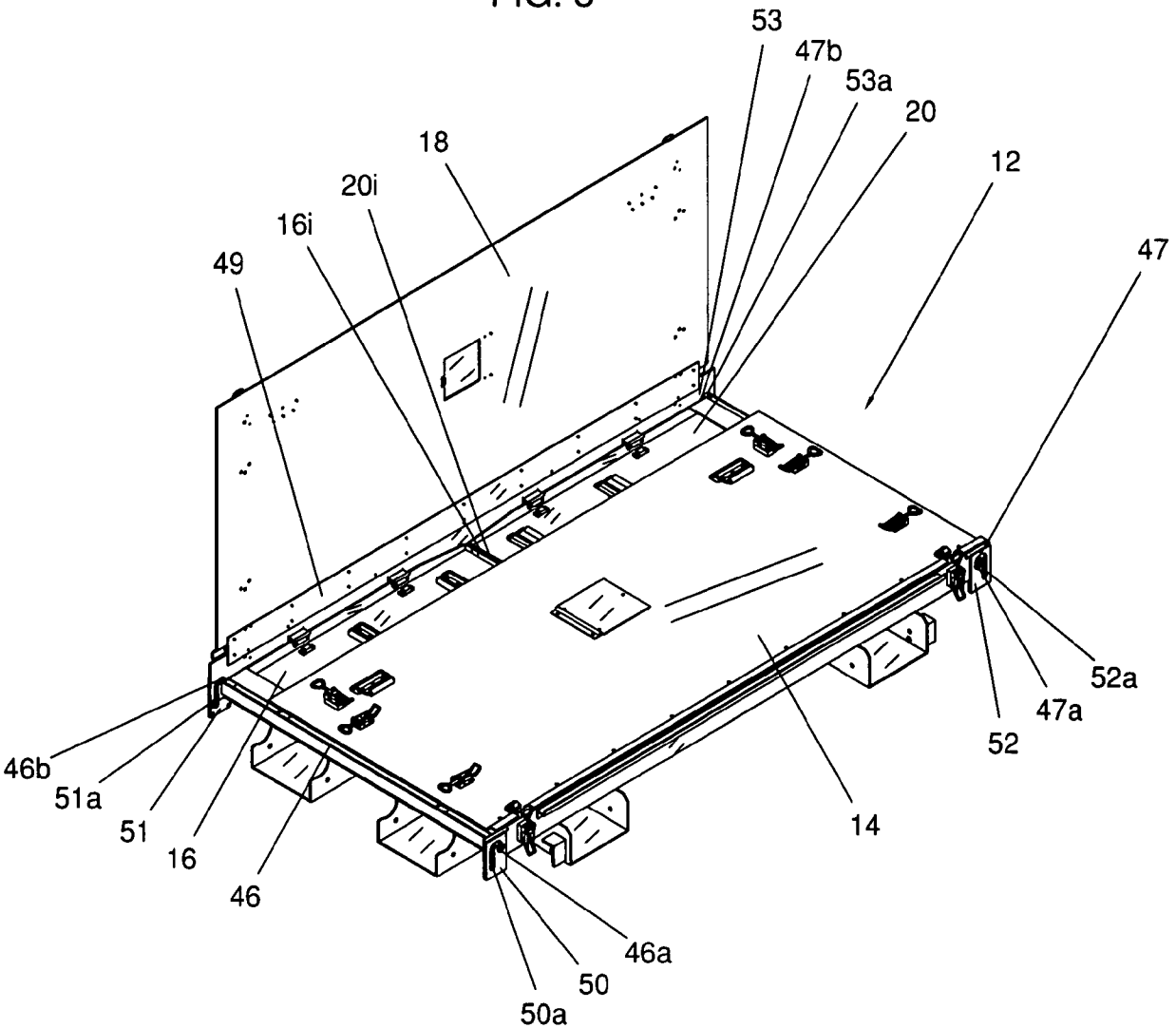
FIG. 5 shows a perspective view of the body portion of the container of FIG. 1, wherein the left ramp, the right ramp, and the front panel are shown in a collapsed state while the rear panel is shown in an erect state.
Figure 11:
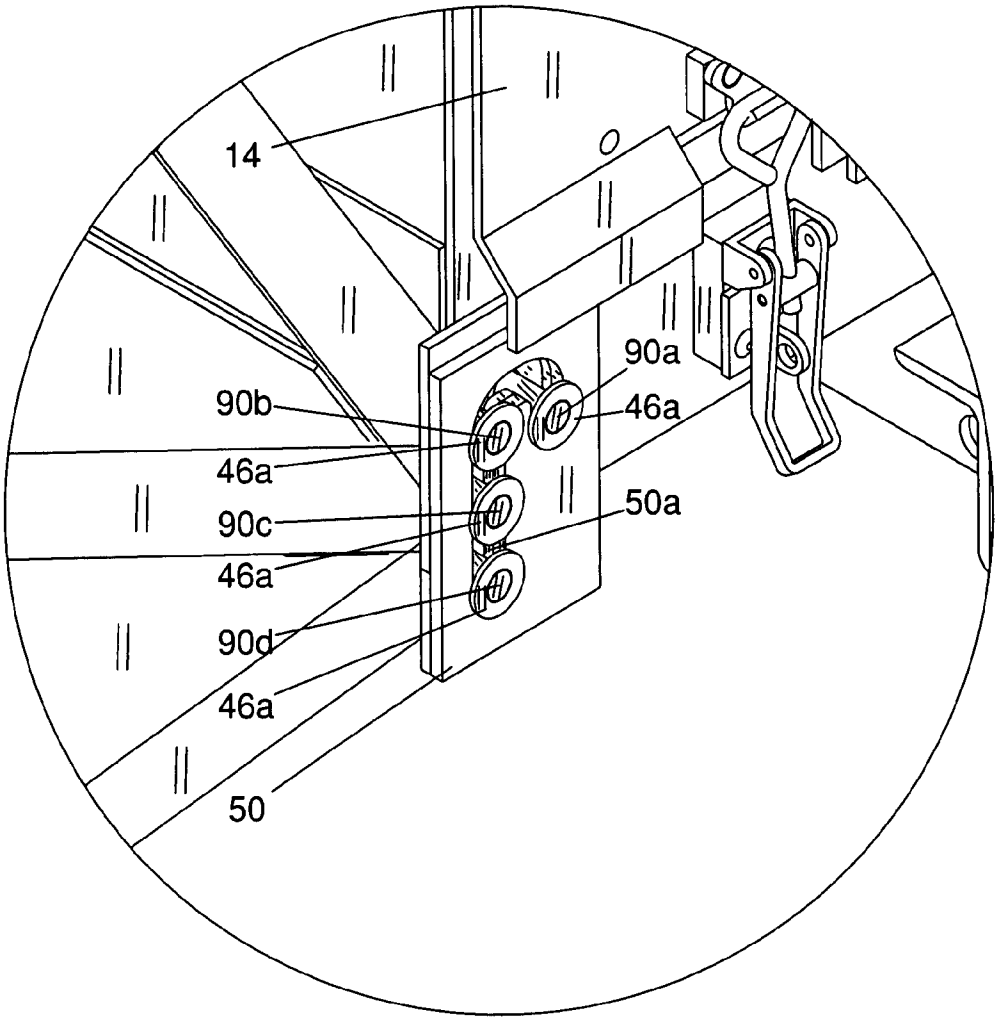
FIG. 11 shows a perspective blown up view of different positions of an end of an axle in an inverted J-shaped slot.

FIG. 5 shows a perspective view of the body portion 12 of the container 1 of FIG. 1, wherein the left ramp 16, the right ramp 20, and the front panel 14 are shown in a collapsed state while the rear panel 18 is shown in an erect state. In FIG. 5, the left ramp 16 is collapsed or folded over the base 30. The left ramp 16 is connected to the base 30 by rod or axle 46. The left ramp 16 can pivot with respect to the base 30 about rod or axle 46. The rod or axle 46 has an end 46*a*, which is shown inserted into an upside down or inverted J-shaped slot 50*a* in a plate 50. The plate 50 is fixed to side 30*c* of the base 30 shown in FIG. 3. The rod or axle 46 also has an end 46*b*, which is shown inserted into an upside down or inverted J-shaped slot 51*a* in a plate 51. The plate 51 is fixed to a side of the base 30 opposite side 30*c*. In the collapsed position of FIG. 5, the end 46*a* lies at a location 90*a* in the inverted J-shaped slot 50*a*, which is shown in FIG. 11, and the end 46*b*, lies in a similar location in the inverted J-shaped slot 51*a*. The location 90*a* lies at a first end of the inverted J-shaped slot 50*a*.

In FIG. 5, the right ramp 20 is collapsed or folded over the base 30. Similar to the left ramp 16, the right ramp 20 is connected to the base 30 by a rod or axle 47. The right ramp 20 can pivot with respect to the base 30 about the rod or axle 47. The rod or axle 47 has an end 47*a*, which is shown in inserted into an inverted J-shaped slot 52*a* in a plate 52. The plate 52 is fixed to side 30*c* of the base 30, shown in FIG. 3. The rod or axle 47 also has an end 47*b*, which is shown inserted into an inverted J-shaped slot 53*a* in a plate 53. The plate 53 is fixed to the base 30 at a side opposite the side 30*c*. In the collapsed position of FIG. 5, the end 47*a* lies at a location at an end of the inverted J-shaped slot 52*a*, similar to the location 90*a*, for the inverted J-shaped slot 50*a* shown in FIG. 11 and the end 47*b* lies at a similar location in the inverted J-shaped slot 53*a*.

Figure 12:
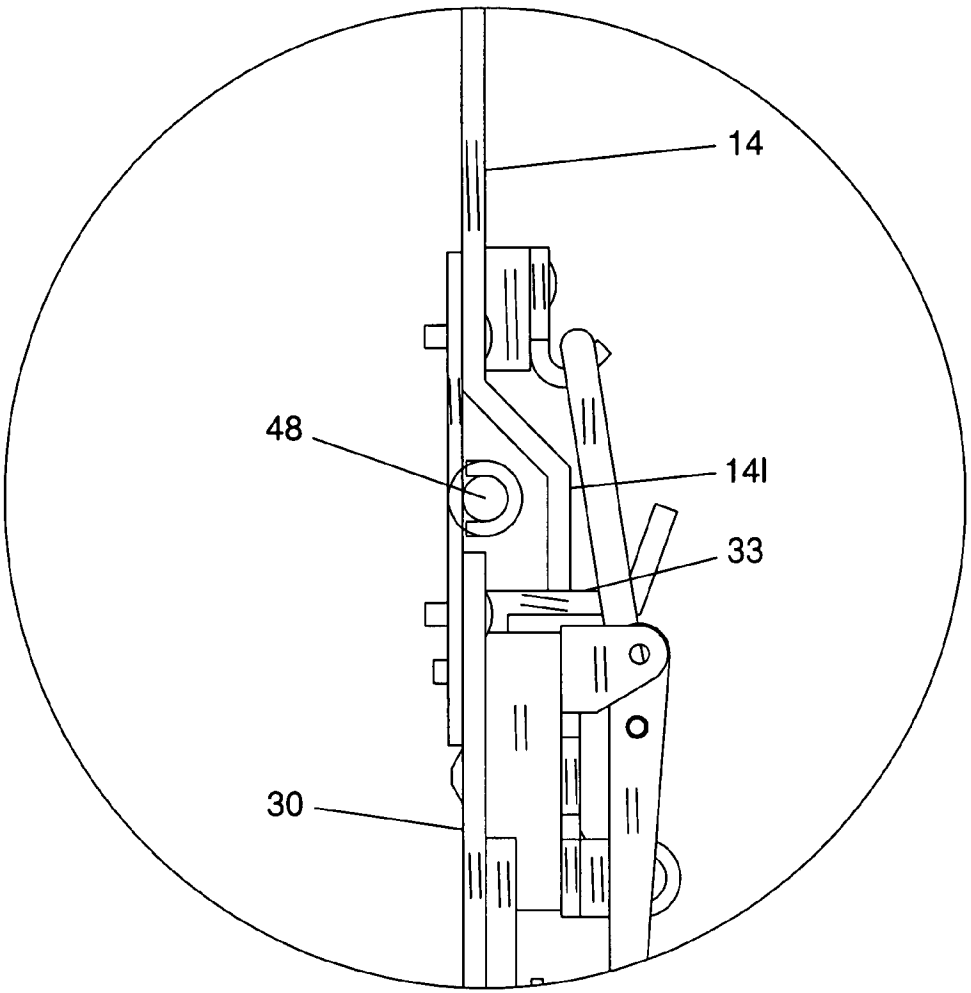
FIG. 12 shows a side blown up view of the front panel connected to the base by a hinge.

In FIG. 5, the left ramp 16 and the right ramp 20 collapse or fold over so that they do not overlap each other, however, this is not a requirement for the operation of this type of container. In one embodiment, the top edge 16i of left ramp 16 and the top edge 20*i* of right ramp 20 as shown in FIG. 3, touch one another or are closely adjacent when the left ramp 16 and right ramp 20 are folded over as in FIG. 5. The front panel 14 is shown in FIG. 5 collapsed or folded over the left ramp 16 and the right ramp 20. The front panel 14 is connected to the base 30 by rod, hinge, or axle 48, shown in FIG. 12. The front panel 14 can pivot with respect to the base 30 about rod, hinge, or axle 48. In this case, the hinge 48 is connected to both the front panel 14 and the base 30 as seen in FIG. 12.

Figure 6:
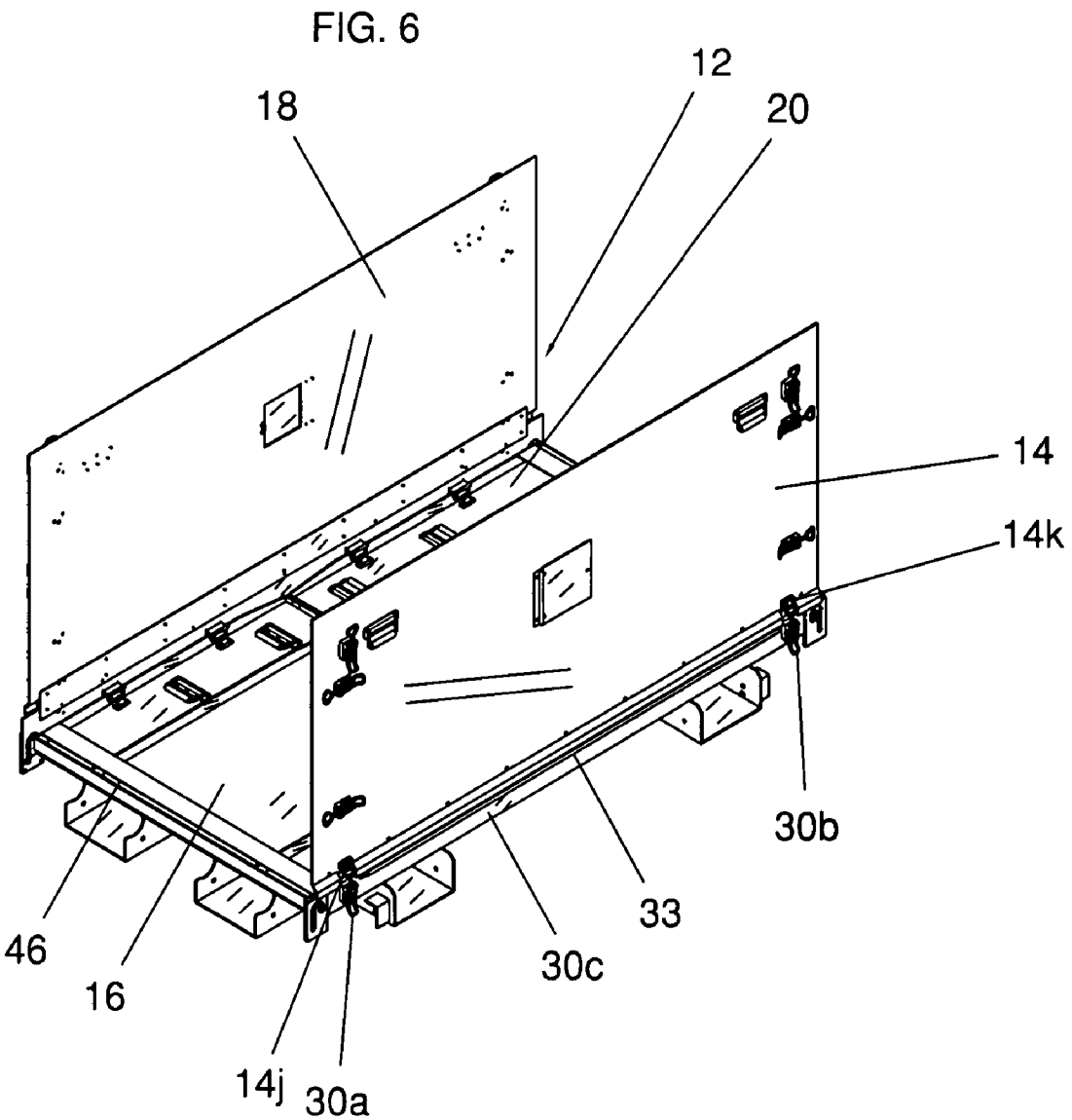
FIG. 6 shows a perspective view of the body portion of the container of FIG. 1, wherein the left ramp and the right ramp are shown in a collapsed state while the front and rear panels are shown in an erect state.

FIG. 6 shows a perspective view of the body portion 12 of the container 1 of FIG. 1, wherein the first ramp 16 and the second ramp 20 are shown in a collapsed state while the front panel 14 and the rear panel 18 shown in an erect state. The front panel 14 is kept erect by the engagement of the latches 30*a* and 30*b* with the keepers, or latching device, 14*j* and 14*k* mounted to the front panel 14. The rear panel 18 is kept erect in a similar fashion.

Figure 7:
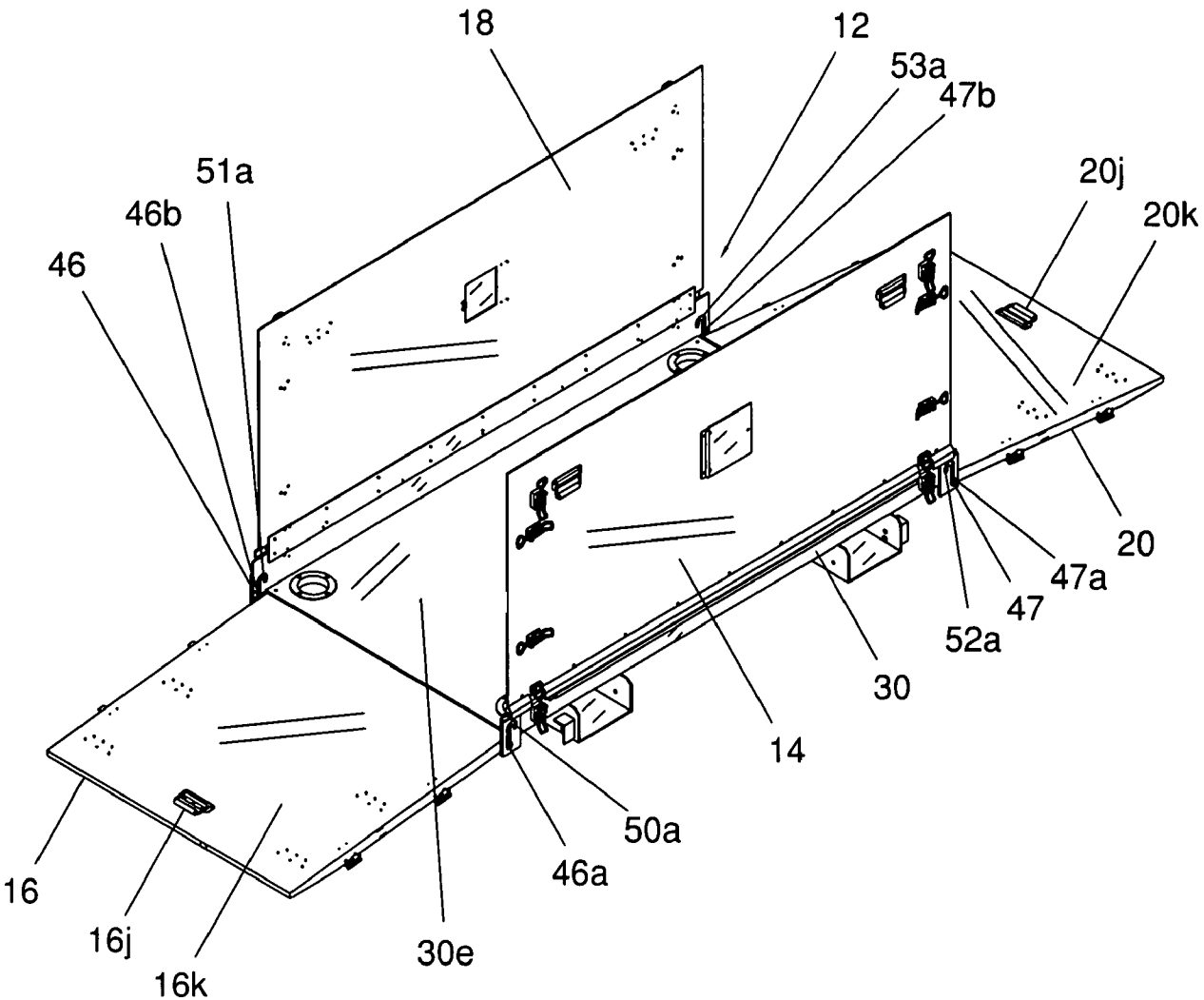
FIG. 7 shows a perspective view of the body portion of the container of FIG. 1, wherein the rear and front panels are in an erect state, and the left ramp and the right ramp are both shown in a down state to allow a vehicle to be rolled over either of the left or right ramps and onto a floor or base of the body portion of the container.

FIG. 7 shows a perspective view of the body portion 12 of the container 1 of FIG. 1, wherein the rear panel 18 and the front panel 14 are in an erect state, and the left ramp 16 and the right ramp 20 are both shown in a down state to allow a vehicle to be rolled over either of the left ramp 16 or the right ramp 20 and onto the floor or base 30 of the body portion 12 of the container 1. The left ramp 16 has a substantially flat inner surface 16*k*. The left ramp 16 includes a portion 16*j* which is a handle that allows the end user to easily lift the left ramp 16 when attempting to close the container 1. Similarly the right ramp 20 has a substantially flat inner surface 20*k* and a handle 20*j*.

In the state of FIG. 7, the end 46*a* of axle 46 is shown inserted into the inverted J-shaped slot 50*a* and at a location 90*d*, shown in FIG. 11, at the bottom, or second end, of the inverted J-shaped slot 50*a*. Similarly, the end 46*b* of the axle 46 is inserted in the slot 51*a* and at a location at the bottom, or second end, of the inverted J-shaped slot 51*a*. Similarly, in FIG. 7, the end 47*a* of axle 47 is shown inserted into the inverted J-shaped slot 52*a* and at a location at the bottom of the inverted J-shaped slot 52*a*. Similarly, the end 47*b* of the axle 47 is inserted in the slot 53*a* and at a location at the bottom of the inverted J-shaped slot 53*a*.

Figure 8:
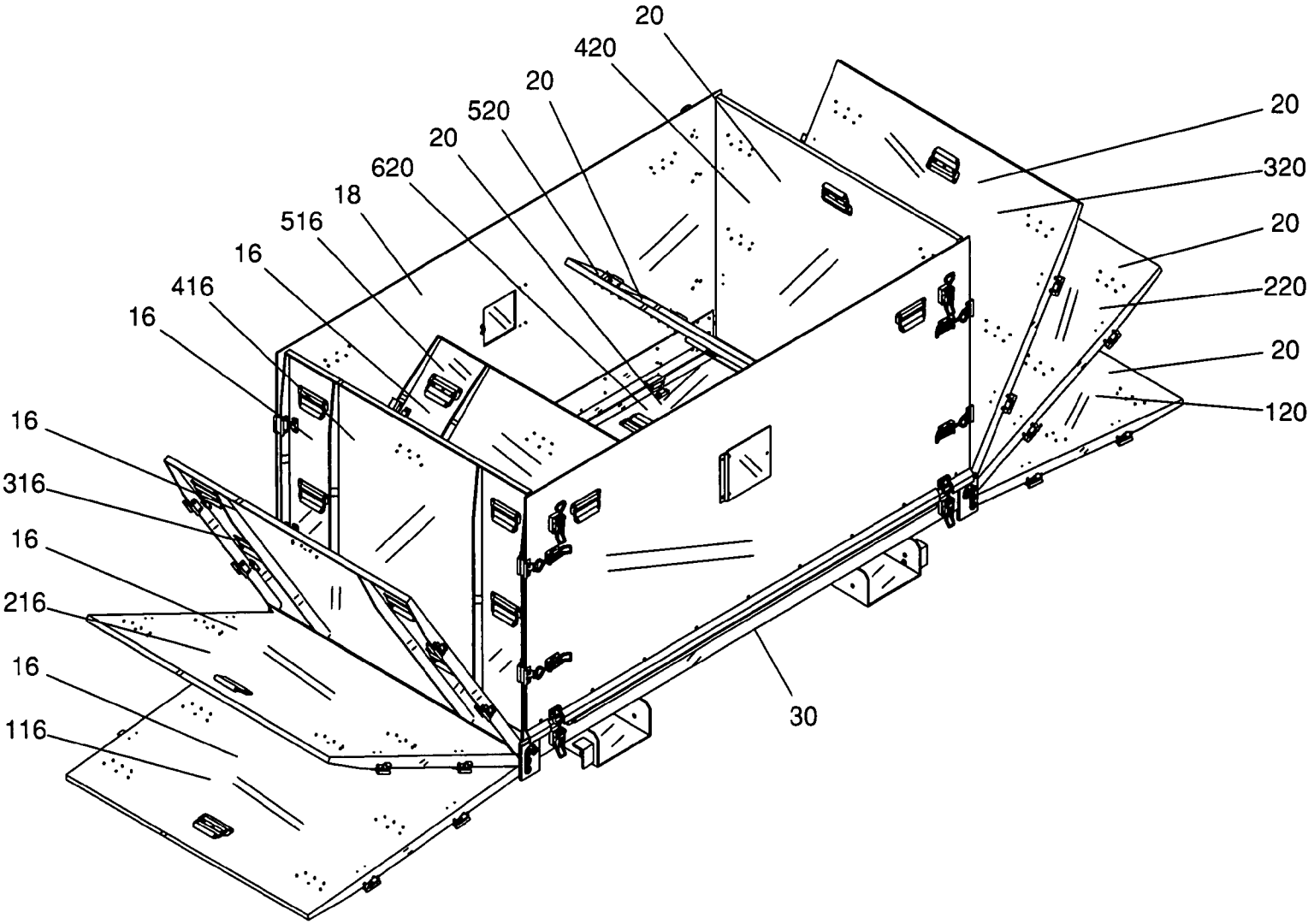
FIG. 8 shows a perspective view of various states of the left and right ramps while the front and rear panels are in an erect state.

FIG. 8 shows a perspective view of various states of the left ramp 16 and the right ramp 20 while the front panel 14 and the rear panel 18 are in an erect state. A left ramp position or state 116 shows the position of the left ramp 16 when it is completely down as in FIG. 7. Left ramp positions or states 216 and 316 show positions of the left ramp 16 when the left ramp 16 is partially up. A left ramp position or state 416 shows the position of the left ramp 16 when the left ramp 16 is fully erect as in FIG. 3. A left ramp position 516 shows the left ramp 16 when it is partially collapsed.

Similarly, a right ramp position or state 120 shows the position of the right ramp 20 when it is completely down as in FIG. 7. Right ramp positions or states 220 and 320 show positions of the right ramp 20 when the right ramp 20 is partially up. A right ramp position or state 420 shows the position of the right ramp 20 when the right ramp 20 is fully erect as in FIG. 3. A right ramp position or state 520 shows the right ramp 20 partially collapsed. A right ramp position or state 620 shows the right ramp 20 fully collapsed.

Figure 9:
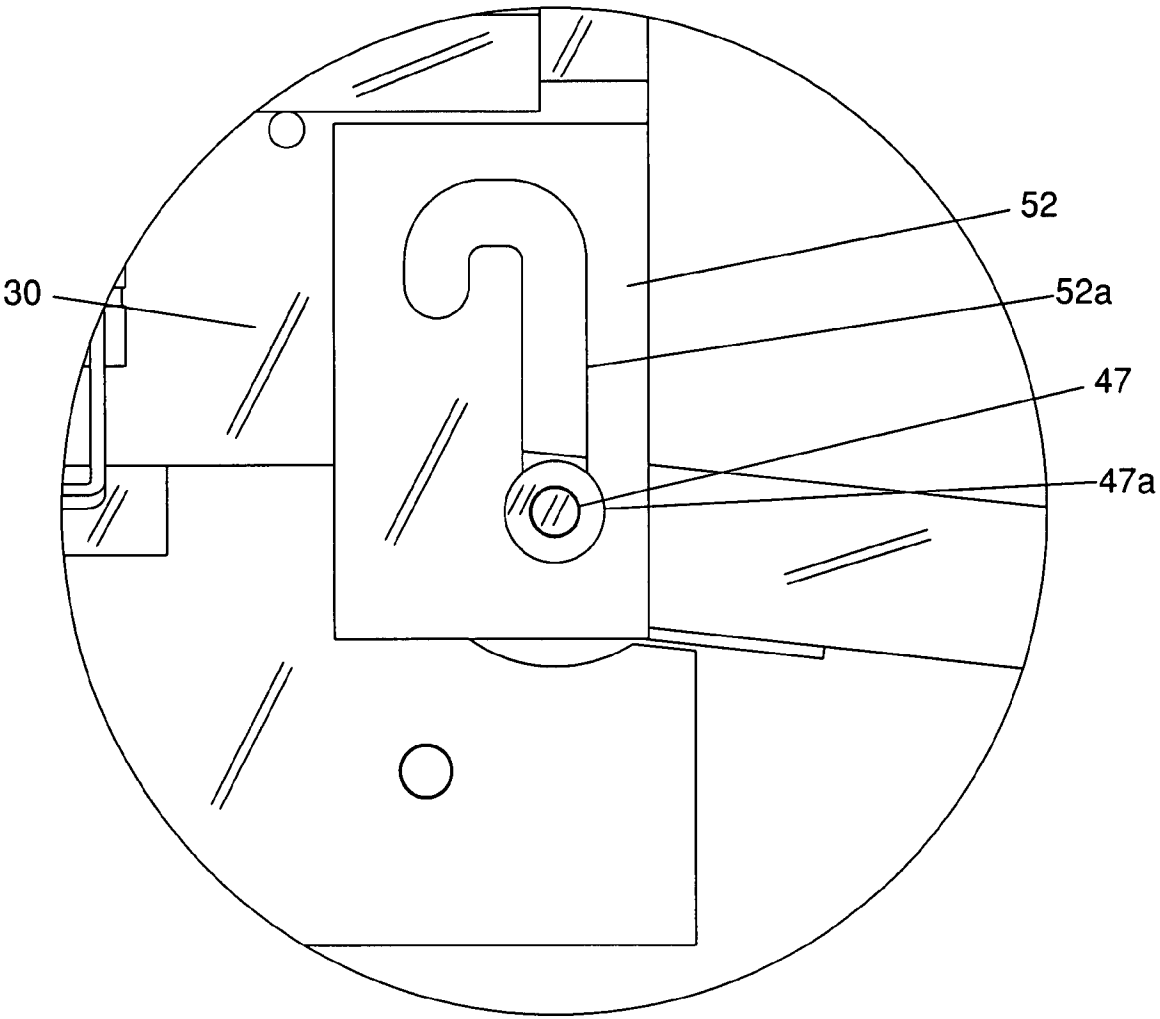
FIG. 9 shows a front blown up view of one of the inverted J-shaped slots of the container shown in FIG. 8.
Figure 10:
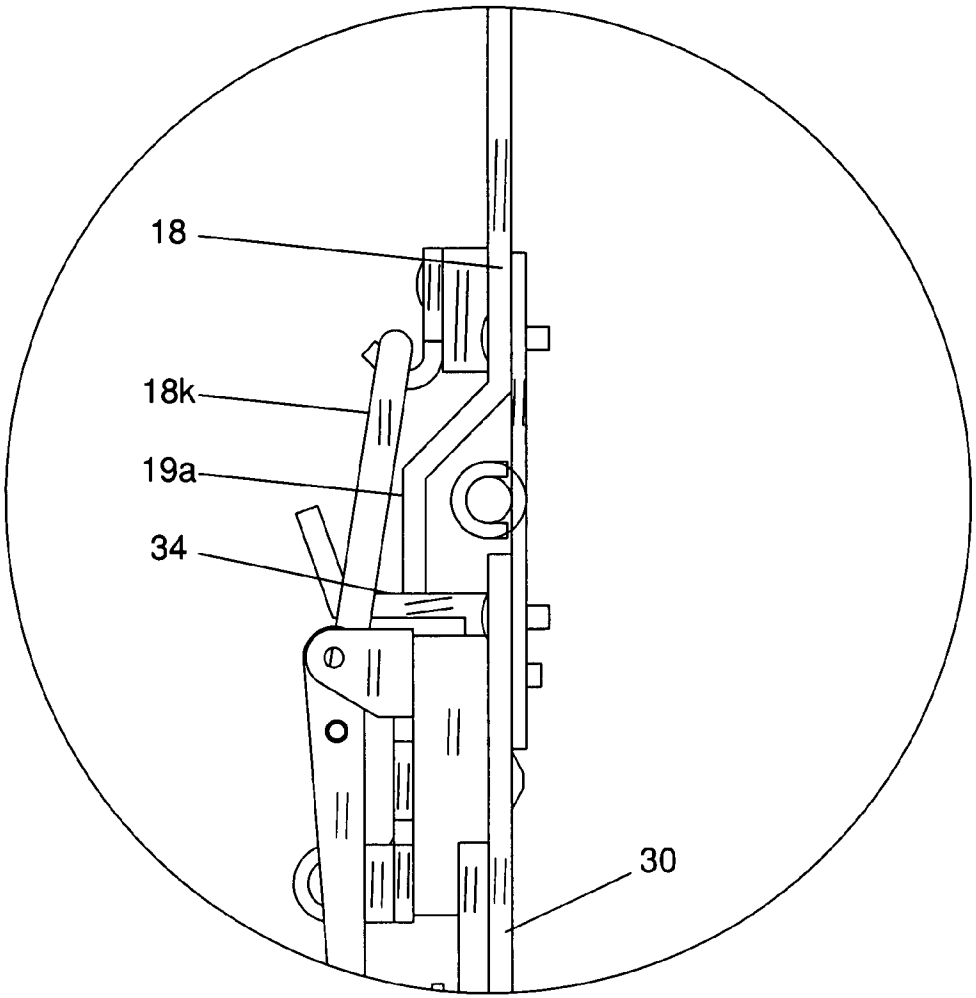
FIG. 10 shows a side blown up view of a connection of two latching devices of the container shown in FIG. 7.

FIG. 9 shows a perspective blown up view of the inverted J-shaped slot 52*a* of the container 1 shown in FIG. 5. FIG. 10 shows a left blown up view of latching device 18*k* which latches to a latching device opposite latching device 30*a* on the base 30 of the container 1 shown in FIG. 7. FIG. 11 shows a perspective blown up view of different positions of an end 46*a* of an axle in the inverted J-shaped slot 50*a*.

In operation, the container 1 may be received in the collapsed state of FIG. 2. In order to change the container 1 from the collapsed state of FIG. 2 to the fully erect state of FIG. 1, the following steps can be followed. Firstly, the latching devices 30*a* and 30*b* on side 30*c* of the base 30 are disconnected from the latching devices 17 and 19 on the surface or side 10*a* of the lid 10, respectively, as shown in FIG. 2. Latching devices similar to latching devices 30*a* and 30*b*, on a side opposite side 30*c* on the base 30, are disconnected from latching devices similar to 17 and 19 on the surface or side 10*d* of the lid 10. The lid 10 can then be lifted off of the base 30 of the body portion 12 (actually sitting on items 33 in FIG. 6 and 34 in FIG. 10) and set down at another location apart from the body portion 12. The body portion 12 in a fully collapsed state, with the lid 10 removed, is shown in FIG. 4. The rear panel 18 can then be folded upwards or rotated upwards, about rod or axle or hinge 49, to which the rear panel 18 is connected, into an upright position as shown by FIGS. 4 and 5. The rear panel 18 can be lifted or folded upwards from the position of FIG. 4 into the position of FIG. 5 by the pulling the handles 18*b* and 18*f* upwards. One person may pull on handle 18*b* and another person may pull on handle 18*f*. The rear panel 18 is held in an upright position by a flange 19*a* resting on item 34 (FIG. 10) and locked into an upright position by latching or connecting latching devices similar to latching device 30*a* and 30*b* shown in FIG. 3, but on the opposite side of the base 30 to devices 18*j* and 18*k* (shown in FIG. 4).

With the rear panel 18 locked in place with respect to the base 30, the front panel 14 can then be unfolded or lifted from the collapsed position of FIG. 5 to the upright position of FIG. 6. The front panel 14 rotates with respect to the base 30 about axle or rod or hinge 48, to which the front panel 14 is connected. The flange 14*l* shown in FIG. 3, of the front panel 14, rests on item 33 similar to the way the flange 19*a* of the rear panel 18 rests on item 34. The flanges 19*a* and 14*l* serve two purposes. First, they give added stability to the body of the container by resting on 34 and 33 respectively. They also act as a means of shielding rain water from running down the front and back panels into the base of the container. It should be noted that a second purpose for items 33 and 34 is to support the lid when the container is in the closed position. The front panel 14 is locked in the upright position of FIG. 6, by connecting latching devices 30*a* and 30*b* of the base 30 to latching devices 14*j* and 14*k* of the front panel 14.

Next, the left ramp 16 is lifted or folded upwards from the collapsed state of FIG. 6, to the erect state of FIG. 3. The left ramp 16 can be lifted, folded or rotated upwards by pulling handles 16*a* and 16*b*. One person may pull on each of handles 16*a* and 16*b*. The left ramp 16 rotates upwards about axle 46 to which the left ramp 16 is connected. When the left ramp 16 is in the fully collapsed position of FIG. 6, the end 46*a* of the rod or axle 46 lies in position 90*a*, at a first end of the inverted J-shaped slot 50*a*, as seen in FIG. 11. The right ramp 20 works in a similar fashion. When the left ramp 16 is lifted up, the ends 46*a* and 46*b* remain at ends 90*a* and an end similar to 90*a*, respectively, of the inverted J-shaped slots 50*a* and 51*a*. The latching devices 16*e* and 16*g* are connected to latching devices 18*h* and 18*i* on the rear panel 18 and the latching devices 16*f* and 16*h* are connected to latching devices 14*d* and 14*e* on the front panel 14 to lock the left ramp 16 in place.

Similarly the right ramp 20 is lifted or folded upwards from the collapsed state of FIG. 6, to the erect state of FIG. 3. The right ramp 20 can be lifted, folded or rotated upwards by pulling handles on right ramp 20, similar to handles 16*a* and 16*b*. One person may pull on each of the handles. The right ramp 20 rotates upwards about axle or rod 47 to which the right ramp 20 is connected. When the right ramp 20 is in the position of FIG. 6, the ends 47*a* and 47*b* of the rod or axle 47 lie at ends, similar to the location of 90*a* shown in FIG. 11, of the inverted J-shaped slots 52*a* and 53*a*, respectively. When the right ramp 20 is lifted up, the ends 47*a* and 47*b* remain at ends similar to the location 90*a* shown in FIG. 11, of the inverted J-shaped slots 52*a* and 53*a*, respectively. Latching devices, on the right ramp 20, similar to latching devices 16*e* and 16*g* are connected to latching devices 18*d* and 18*e* on the rear panel 18 and latching devices, on the right ramp 20, similar to latching devices 16*f* and 16*h* are connected to latching devices 14*h* and 14*i* on the front panel 14 to lock the right ramp 20 in place.

After the body portion 12 is in the erected state of FIG. 3, the lid 10 can be placed back on the body portion 12 as shown by FIG. 1. The lid 10 can be picked up by two people. One person would lift one end by holding the ring 31*e* in one hand and holding the ring 31*f* in his or her other hand, and another person would lift the other end by holding the ring similar to 31*e*, but on side 10*b* of the lid 10, in one hand and holding the ring similar to 31*f*, but on side 10*b* of the lid 10, in his or her other hand. After the lid 10 is placed on top of the body portion 12 as shown in FIG. 1, the latching devices 14*c* and 14*g* on the front panel 14 can be latched or connected to latching devices 17 and 19 of the lid 10. Similarly, the latching devices 18*g* and 18*c* on the rear panel 18 can be latched or connected to latching devices on side 10*d* of the lid 10. This secures the lid 10 to the body portion 12.

The procedure for dropping one of the ramps of left ramp 16 and right ramp 20, will be described with reference to left ramp 16. The body portion 12 for purposes of this description, starts out in the erect state of FIG. 3, with the lid 10 removed. The left ramp 16 is latched to the rear panel 18 by latching devices 16*e* and 16*g* connected to latching devices 18*h* and 18*i*, respectively, and latched to the front panel 14 by latching devices 16*f* and 16*h* connected to latching devices 14*d* and 14*e*, respectively. The left ramp 16 is disconnected from the rear panel 18 and the front panel 14 by disconnecting latching devices 16*e* and 16*g* from latching devices 18*h* and 18*i*, respectively, and disconnecting latching devices 16*f* and 16*h* from latching devices 14*d* and 14*e*, respectively.

The left ramp 16 is then pulled upwards so that the ends 46*a* and 46*b* of the rod or axle 46 are pulled upwards to the highest point of inverted J-shaped slots 50*a* and 51*a*. Referring to FIG. 11, for inverted J-shaped slot 50*a*, this would be a location between 90*a* and 90*b*, at the top of the inverted J-shaped slot 50*a*. The left ramp 16 is then dropped downwards, so that the ends 46*a* and 46*b* of the rod or axle 46 are dropped into the longer part of the inverted J-shaped slots 50*a* and 51*a*, respectively. The end 46*a* is dropped downwards through the positions 90*b*, 90*c*, and 90*d* shown in FIG. 11. The left ramp 16 is then rotated downwards through the positions 316, 216 and 116 shown in FIG. 8. The use of the inverted J-shaped slots 50*a* and 51*a* (for left ramp 16), allows the surface 16*k* of the left ramp 16 to be even with the surface 30*e* as seen in FIG. 7. This allows a heavy vehicle or other heavy cargo to be easily rolled into or slid into the cargo region or chamber 32 (shown in FIG. 7, which will be bound by ramps 16 and 20 and walls or panels 14 and 18) and prevents the cargo from being damaged. It should be noted that ramp 16 may be dropped while the axle 46 is in location 90*a* as shown in FIG. 11. In this configuration, the surface 16*k* of the left ramp 16 will not be even with the surface 30*e* of the base 30. This technique may be used if an even loading surface between the left ramp 16 and surface 30*e* of the base 30 is not required. The same applies for the right ramp 20.

The right ramp 20 can be lowered in a manner similar to or identical to the left ramp 16. The right ramp 20 can be lowered from the erect position 420 through positions 320, 220, and 120, shown in FIG. 8.

The left ramp 16 includes magnets 16*m*, 16*n*, 16*o*, and 16*p*. When the latching devices 16*e*, 16*g*, 16*f*, and 16*h* are disconnected from latching devices on the rear panel 18 or front panel 14, they can be attached to the magnets. This prevents damage from occurring to the latching devices 16*e*-16*h* when the ramp 16 is in the position shown in FIG. 7. Latching devices 16*e*, 16*f*, 16*g*, and 16*h* can be attached to magnets 16*m*, 16*o*, 16*n*, and 16*p*, respectively. Magnets similar to magnets 16*m-p* are also located on the right ramp 20.

Flanges 19*a* and 14*l* as seen in FIG. 10 and FIG. 12, respectively, on the front and back panels are used not only as protection against the weather, but give added stability to the body 12 of the container 1 by flange 19*a* resting on component 34, and flange 14*l* resting on component 33.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a first container comprising:

a first base comprised of first, second, third, and fourth sides, the first and third sides substantially parallel to each other and spaced apart by the second and fourth sides, the second and fourth sides substantially parallel to each other and spaced apart by the first and third sides, the first and third sides substantially perpendicular to the second and fourth sides;

a first wall located adjacent the first side of the first base;

a second wall located adjacent the second side of the first base;

a third wall located adjacent to the third side of the first base;

a fourth wall located adjacent to the fourth side of the first base;

wherein each of the first, second, third, and fourth walls, can he placed in an erect state, substantially perpendicular to the first base;

wherein the first container is configured so that the first container can he placed in a collapsed state in which each of the first, second, third, and fourth walls lie substantially over the first base and substantially parallel to the first base;

and wherein the first container is configured so that the first container can he placed in a mixed state in which each of the second and fourth walls is erect and substantially perpendicular to the first base, while each of the first and third walls is in a ramp state in which each of the first and third walls wall lies substantially adjacent to, but not substantially over the first base, and at an angle of about five degrees with respect to the first base;

wherein the first container is configured so that a vehicle can be rolled over the first wall and then onto the first base when the first wall is in a ramp state in which the first wall lies substantially adjacent to, but not substantially over the first base, and at an angle of about five degrees with respect to the first base; and wherein the first container is configured so that a vehicle can be rolled over the third wall and then onto the first base, when the third wall is in a ramp state in which the third wall lies substantially adjacent to, but not substantially over the first base, and at an angle of about five degrees with respect to the first base.

2. An apparatus comprising:

a first container comprising:

a first base comprised of first, second, third, and fourth sides, the first and third sides substantially parallel to each other and spaced apart by the second and fourth sides, the second and fourth sides substantially parallel to each other and spaced apart by the first and third sides, the first and third sides substantially perpendicular to the second and fourth sides;

a first wall located adjacent the first side of the first base;

a second wall located adjacent the second side of the first base;

a third wall located adjacent to the third side of the first base;

a fourth wall located adjacent to the fourth side of the first base;

wherein each of the first, second, third, and fourth walls, can be placed in an erect state, substantially perpendicular to the first base;

wherein the second wall can be placed in and kept in an erect state substantially perpendicular to the first base without the support of the first, third, and fourth walls;

wherein the fourth wall can be placed in and kept in an erect state substantially perpendicular to the first base without the support of the first, second, and third walls;

wherein the first container is configured so that the first container can be placed in a collapsed state in which each of the first, second, third, and fourth walls lie substantially over the first base and substantially parallel to the first base;

and wherein the first container is configured so that the first wall can be placed in a ramp state in which the first wall lies substantially adjacent to, but not substantially over the first base, and at an angle of about five degrees with respect to the first base, while at least one of the second and the fourth walls is kept in an erect state by a support means without the support of the other walls of the first, second, third, and fourth walls, so that the at least one of the second and the fourth walls is substantially perpendicular to the first base.

3. The apparatus of claim 2 wherein the support means includes a flange.

4. The apparatus of claim 2 further comprising a lid which can be connected to the first, second, third, and fourth walls; and wherein in their erect state, the first, second, third, and fourth walls form four sides of an open box structure and the first base forms a bottom of the open box structure, and the lid can be used to close the open box structure.

5. The apparatus of claim 2 wherein the support means includes a latching device which locks the at least one of the second and the fourth walls in an erect state substantially perpendicular to the first base.

* * * * *